US005153997A

United States Patent [19]

Chiavaras et al.

[11] Patent Number: 5,153,997

[45] Date of Patent: Oct. 13, 1992

[54] ERGONOMIC SCISSORS

[75] Inventors: Charles G. Chiavaras; Ronald J. Neimkin; Deborah P. Neimkin, all of Asheville, N.C.

[73] Assignee: Ergonomic Tool Associates, Asheville, N.C.

[21] Appl. No.: 774,994

[22] Filed: Oct. 11, 1991

[51] Int. Cl.[5] ..... B26B 13/12; B26B 13/04; B26B 13/28

[52] U.S. Cl. ..... 30/257; 30/235; 30/248

[58] Field of Search ..... 30/233, 235, 248, 257, 30/318, 194

[56] References Cited

U.S. PATENT DOCUMENTS

| | | | |
|---|---|---|---|
| D. 310,714 | 9/1990 | Dolwick . | |
| 590,330 | 9/1897 | Nolen . | |
| 673,043 | 4/1901 | Burner . | |
| 733,919 | 7/1903 | Schwartz . | |
| 833,714 | 10/1906 | Goode . | |
| 881,890 | 3/1908 | Barr . | |
| 968,219 | 8/1910 | Wheeler . | |
| 973,296 | 10/1910 | Peddle | 30/233 |
| 1,042,240 | 10/1912 | Lillick . | |
| 1,330,515 | 2/1920 | Bryant | 30/257 |
| 3,034,214 | 5/1962 | Bosse | 30/257 |
| 3,066,412 | 12/1962 | Melton | 30/257 |
| 4,146,961 | 4/1979 | Pinto . | |
| 4,254,551 | 3/1981 | Megna . | |
| 4,315,369 | 2/1982 | Borow . | |
| 4,345,378 | 8/1982 | Pracht . | |
| 4,642,895 | 2/1987 | Gauvry . | |
| 5,060,381 | 10/1991 | Taberlet | 30/194 |

*Primary Examiner*—Douglas D. Watts
*Assistant Examiner*—Paul M. Heyrana, Sr.
*Attorney, Agent, or Firm*—Carter & Schnedler

[57] ABSTRACT

There is provided improved ergonomic scissors which are particularly useful for barbers, hair designers, and other hair stylists. The scissors include a pair of beams rotatably attached to one another at a pivot point. Each beam includes a cutting edge and a handle. Each handle includes a loop for securing a digit thereto. Each loop is at an angle with respect to the remainder of its beam so that the loop projects out of the plane of rotation of the remainder of its beam.

7 Claims, 4 Drawing Sheets

ERGONOMIC SCISSORS

BACKGROUND OF THE INVENTION

This invention relate to cutting apparatus. More particularly, it relates to scissors for use by hair designers, barbers and other hair stylists for cutting hair.

Typical scissors which are currently widely used to cut and trim hair is shown in FIG. 1. A pair of beams 10 and 12 are rotatably attached to one another by screw 14, which forms a pivot point. The beams include handles 16 and 18 each having loops for securing one's digits thereto. The beams also include a pair of cutting edges 20 and 22 which cut the hair by the closure of the beams. The cutting edges and handles are in the same plane of rotation, i.e. the beams are straight.

During the course of cutting and trimming hair using prior art straight scissors, the stylist must assume various positions which may result in cumulative physical trauma requiring specialized medical treatment. In order to cut the hair using straight scissors, the stylist must position his or her wrist both in extreme dorsiflexion as well as palmarflexion. An example of extreme palmarflexion by a hair stylist is shown in FIG. 2. These positions of the wrist when done repetitively often result in various traumas including carpal tunnel syndrome (median nerve compression at the wrist), tenosynovitis (inflammation of flexor or extensor tendons) and lateral epicondylitis (tennis elbow). Furthermore, by using the straight scissors, the stylist often must raise the elbow 13 to an uncomfortable position and abduct the shoulder 15 to approximately 90° which will increase the chances of tendonitis or bursitis of the shoulder and further increases the incidence of thoracic outlet syndrome (brachial plexus compression by the neck muscles and the first rib). There is a higher incidence of this syndrome in females due to their neck anatomy and the size of their breasts.

In addition to medical problems, the stylist will normally cut opposing sides of the head in the opposite directions resulting in an uneven flow of the hair which may alter the appearance of the hair design. In addition, the use of the straight scissors requires the client to change position of the head very often during the cut.

It is therefore desirable to provide a new design of scissors which overcomes the problems of the prior art straight scissors.

OBJECTS OF THE INVENTION

It is therefore one object of this invention to provide ergonomically designed scissors.

It is another object to provide scissors for cutting hair which reduces the probability that the user will suffer cumulative physical strain and trauma.

It is another object to provide ergonomically designed scissors for use by a hair stylist which enables a higher quality haircut.

It is still another object of the invention to provide ergonomic scissors which are not substantially more expensive to produce than conventional scissors and which are easier to use.

SUMMARY OF THE INVENTION

In accordance with one form of this invention there is provided a scissors for cutting hair which includes first and second beams. Each of the beams has a shearing edge and a handle. A pivot mechanism is provided between the shearing edge and the handle of each beam.

The pivot mechanism also affixes the first and second beams together and permits the beams to rotate with respect to one another. Each handle includes a first and second portion. The first portion is located nearer to the pivot mechanism than the second portion. The second portion includes a means for securing at least one digit thereon. The means for securing is on a different plane from the first portion of the handle. It is preferable that each handle includes a bend which divides the first portion from the second portion at an angle which may be between 60° and 120°. It if further preferred that the shearing edge of each beam is in substantially the same plane as the first portion of the handle.

In accordance with another form of this invention, there is provided a method for cutting hair utilizing the above-described scissors. The stylist places two of his or her digits through loops, which may be used to form the means for securing, in one direction. The stylist then cuts the hair on one side of the head. The stylist then places the same digits through the opposite loops in the opposite direction and then cuts the hair on the other side of the head.

By utilizing the above-described scissors, the probability that the stylist will suffer various traumas such as, for example, carpal tunnel syndrome, tenosynovitis, lateral epicondylitis, tendonitis and/or bursitis of the shoulder, neck strain, as well as thoracic outlet syndrome is substantially reduced. Furthermore, the quality of the haircut and the comfort of the client are increased without adding significant cost to manufacturer of the scissors. In addition stylists find these scissors easy to operate and the use thereof will improve their ability to visualize the cut due to improved body position of the stylists.

BRIEF DESCRIPTION OF THE DRAWINGS

The subject matter which is regarded as the invention is set forth in the appended claims. The invention itself however together with further objects and advantages thereof may be better understood by reference to the following description taken in conjunction with the accompanying drawings in which:

DESCRIPTION OF THE PREFERRED EMBODIMENT

Figure 1:
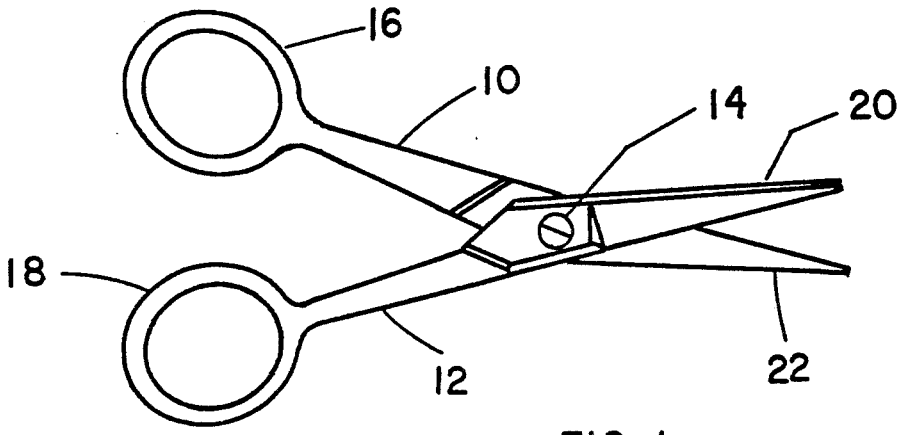
FIG. 1 PRIOR ART
FIG. 1 is a pictorial view of a typical prior art scissors.
Figure 2:
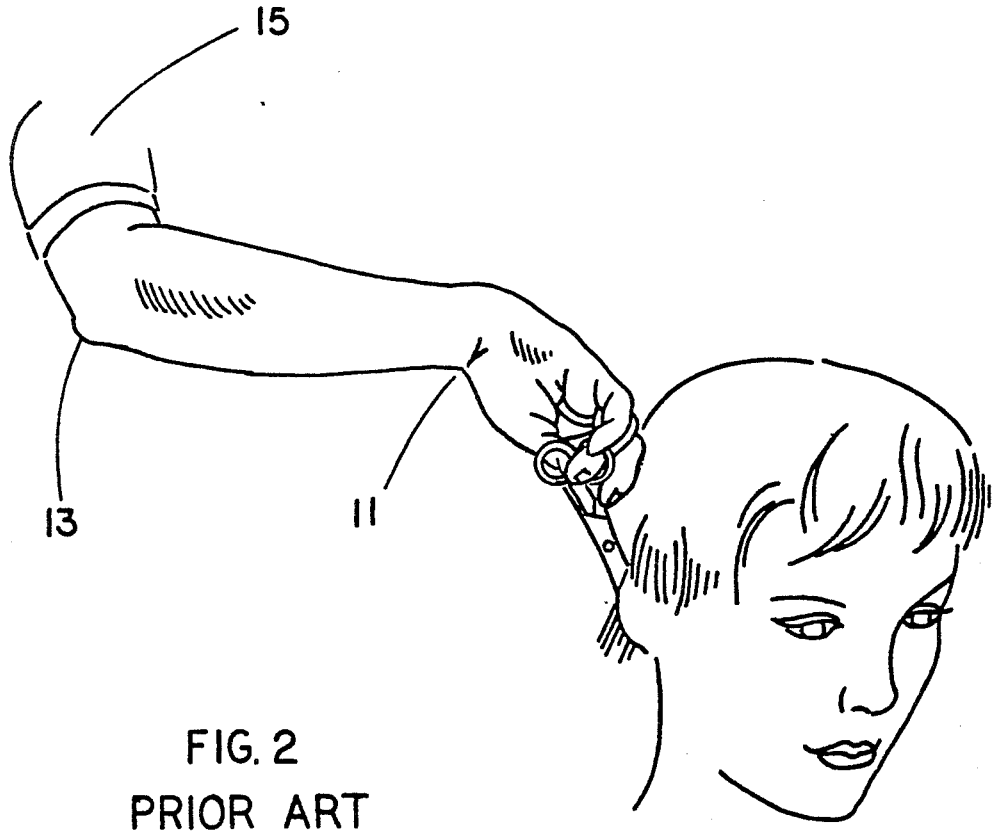
FIG. 2 PRIOR ART
FIG. 2 is a pictorial view of the scissors shown in FIG. 1 in use cutting hair.
Figure 3:
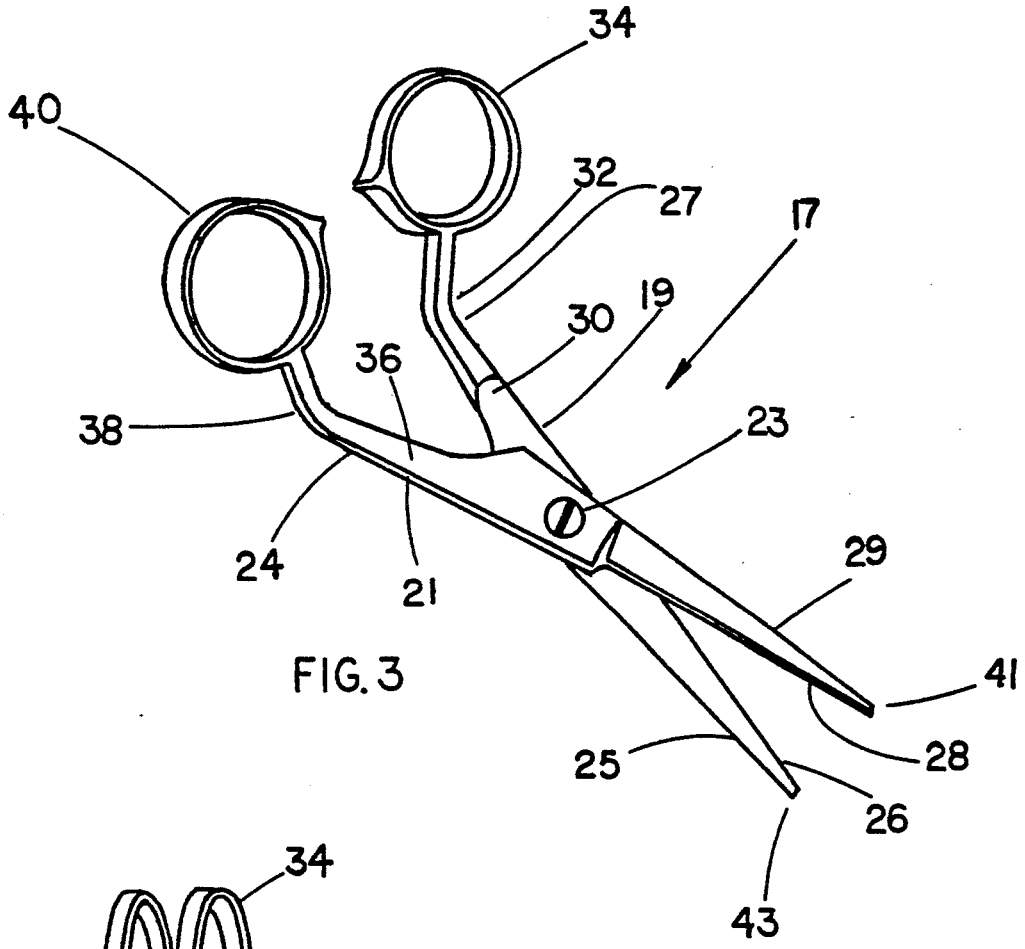
FIG. 3 is a pictorial view of the ergonomic scissors of the subject invention.
Figure 4:
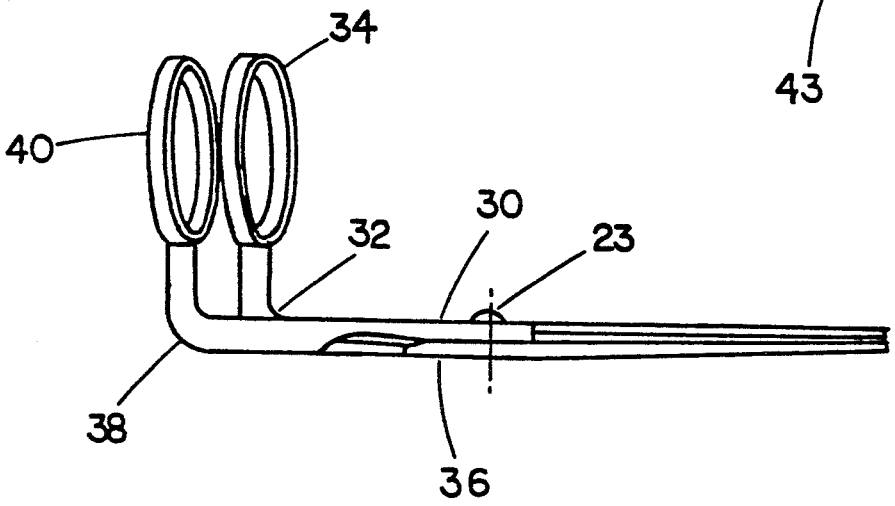
FIG. 4 is a pictorial view showing the ergonomic scissors of FIG. 3 from another angle.

Referring now more particularly to FIGS. 3 through 8, there is provided scissors 17 having beams 19 and 21. Preferably the scissors are made from a high quality steel, cobalt/steel alloy, or ceramic. The beams are swivelably connected together by pivot screw 23 which penetrates through threaded openings in the beams.

Screw 23 thus forms a pivot point so that the beams 17 and 19 may rotate with respect to one another.

Beam 19 includes first portion 25 and second portion 27. Beam 21 includes first portion 29 and second portion 24. Portions 25 and 24 include cutting edges 26 and 28, respectively. The cutting edges are sharp and are in close tolerance of one another so that upon closure of the edges hair is easily cut without undue effort by the stylist. Portion 27 of beam 19 includes stabilizing segment 30, bend 32, and a digit receiving eyelet 34. Portion 24 of beam 21 also includes stabilizing segment 36 and bend 38 and digit receiving eyelet 40.

Figure 5:
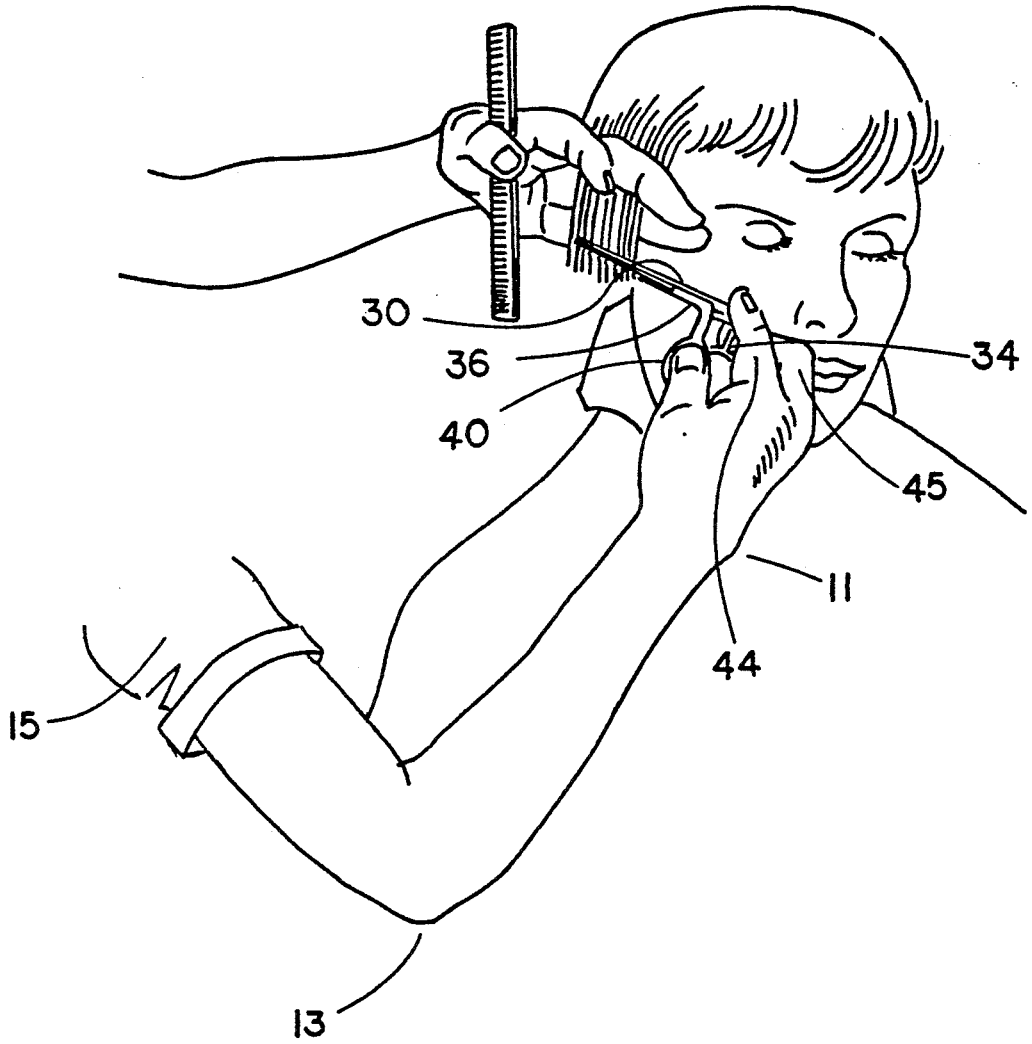
FIG. 5 is a pictorial view showing the ergonomic scissors of FIG. 3 in use cutting the hair on one side of the head of a client.
Figure 6:
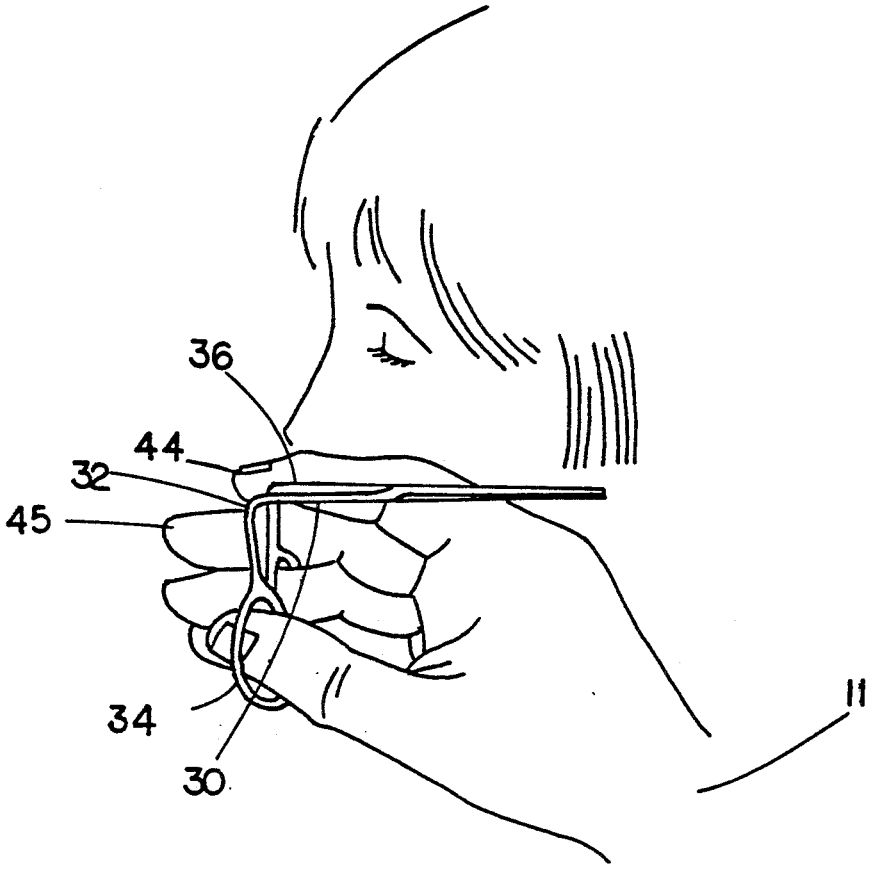
FIG. 6 is a pictorial view showing the ergonomic scissors of FIG. 3 being used to cut the hair on the opposite side of the head of a client.

Normally eyelet 40 receives the stylist's thumb, eyelet 34 receives the ring finger and stabilizing segment 30 is contacted by the index and middle fingers, as shown in FIG. 5, when the scissors are used to cut the hair on one side of the client's head with the tips of the thumb and ring finger pointing substantially in the same direction as the tips 41 and 43 of the scissors. However, as shown in FIG. 6, eyelet 34 receives the thumb, eyelet 40 receives the ring finger, and stabilizing segment 36 is contacted by the index and middle fingers when the scissors are used to cut the hair on the other side of the client's head with the tips of the thumb and ring finger pointing in the direction substantially opposite to the tips 41 and 43 of the scissors.

The bends 32 and 38 in beams 25 and 29 are provided to enable the stylist to utilize the scissors to cut hair while substantially reducing the maximum dorsiflexion and palmarflexion of the stylist's wrist 42, thus reducing the likelihood of repetitive motion injuries such as carpal tunnel syndrome, tenosynovitis, and lateral epicondylitis. The reduction in shoulder abduction decreases tendonitis and bursitis of the shoulder. Furthermore, the likelihood of neck strain as well as thoracic outlet syndrome is substantially reduced.

In the preferred embodiment bends 32 and 38 are approximately 90° with respect to the plane of rotation of the first portions 25 and 29 of the beams. However it is believed that the risk of the injuries described above will be substantially reduced so long as the bends 32 and 38 are within the range of 60° to 120° from the plane of rotation.

Figure 7:
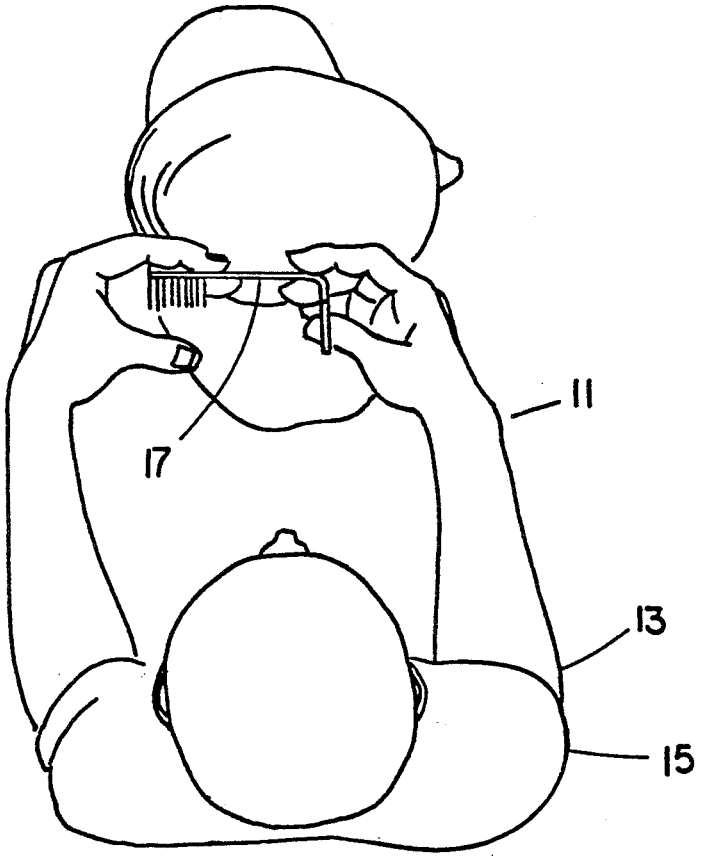
FIG. 7 is a top view of FIG. 5.

As shown in FIG. 5 the hair on the right side of the head of the client is being cut in a direction away from the face and toward the back of the head, in a direction away from the stylist. However when cutting the hair on the left side of the head as shown in FIG. 6, the scissors are reversed. That is, the thumb is place in loop 34 and the ring finger is placed in loop 40 and the scissors are moved from the front of the head toward the rear of the head. In both FIGS. 5 and 6, the scissors are stabilized by the use of index finger 44 and middle finger 45. In the cutting position shown in FIG. 5, the index and middle fingers normally contact the side surface of stabilizing section 30 while in the cutting position shown in FIG. 6, the index and middle fingers normally contact the bottom and side surfaces of stabilizing section 36. Thus the bend in the scissors is provided without sacrificing a place where the index and middle fingers may be used to provide stabilization of the scissors for an accurate haircut. In both cutting positions shown in FIGS. 5 and 6 the stylist's wrist 11 is not severely dorsiflexed or palmarflexed and remains substantially straight and stable during the entire procedure. Furthermore, the elbow 13 is in a comfortable down position and the shoulder 15 is not abducted as shown in FIGS. 5 and 7.

Also it has been found that the client does not have to move his or her head nearly as much during the procedure with the use of the above-described scissors since the stylist is in a comfortable position and is not competing with the client for a more comfortable position, i.e. moving the client's head to decrease the positional strain on the stylist.

The above-described scissors may be operated by the stylist as follows. The stylist places his or her thumb through loop 40, places the ring finger through loop 34, and places his or her index finger on stabilizing segment 30 and begins cutting the hair on the left side of the head of the client, keeping the wrist 11 substantially straight. While standing to the side and somewhat to the front of the client, the client's head may remain in a comfortable straight position. After coming to approximately the center of the back of the head, the stylist then reverses the direction of the scissors and places the thumb through loop 34, the ring finger through loop 40 and the index and middle fingers on the bottom and side of stabilizing segment 30. The stylist then begins to cut the hair on the right side of the client's head, standing to the right side and slightly behind the client, cutting the hair toward the stylist, completing the cut at the middle of the back of the head. The remaining portions of the hair are cut, again by keeping the wrist 11 substantially straight and depending on what needs to be cut, in upward and/or downward direction.

A new and unique scissors is provided which substantially reduces the probability of cumulative trauma disorders for the stylist, provides more comfort for the client, and enables a more evenly distributed cut in that the hair is cut in the same directions on both sides of the head. The scissors described above is easy and inexpensive to manufacture. The digit receiving portions should be at an angle between 60° and 120° out of the plane of rotation of the remainder of the scissors and preferably are 90° out of the plane of rotation.

From the foregoing description of the preferred embodiment of the invention it is apparent that many modifications may be made therein without departing from the true spirit and scope thereof. It is intended in the appended claims to cover all such modifications.

We claim:

1. A scissors for cutting hair adapted to be operated, at least in part, by a pair of digits comprising: first and second beams; each of said beams having a shearing edge and a handle; pivot means; said pivot means affixing said first and second beams together and permitting said beams to rotate with respect to one another; said pivot means located between said shearing edge and said handle of each of said beams; each of said handles including first and second portions; said first portions located nearer to said pivot means than said second portions; said second portions are at an angle between 60° and 120° to the first portions; said second portions each including means for securing each digit thereon; said means for securing being in a different plane from the plane of rotation of said first portions and said shearing edges when said digits are closed and in a different plane when said digits are fully open.

2. A scissors as set forth in claim 1 wherein said angle is 90°.

3. A scissors as set forth in claim 1 wherein said means for securing includes a loop in each of said beams.

4. A scissors as set forth in claim 1 wherein said first portion is of sufficient size to enable one of the user's digits to make substantial contact therewith for stabilizing the scissors during use.

5. A scissors as set forth in claim 1 wherein said shearing edge of each of said beams is substantially on the same plane as said first portion.

6. A scissors as set forth in claim 1 wherein said pivot means includes a screw and a threaded hole in each of said beams.

7. A scissors as set forth in claim 1 wherein said means for securing includes a loop on each of said beams.

* * * * *